US008198826B2

(12) United States Patent
Lin et al.

(10) Patent No.: US 8,198,826 B2
(45) Date of Patent: Jun. 12, 2012

(54) ILLUMINATION SYSTEM AND ILLUMINATION CONTROL METHOD THEREOF

(75) Inventors: Chih-Hua Lin, Hsin-Chu (TW); Jung-Min Hwang, Hsin-Chu (TW); Yu-Chin Lan, Hsin-Chu (TW)

(73) Assignee: Young Lighting Technology Inc., Hsin-Chu (TW)

( * ) Notice: Subject to any disclaimer, the term of this patent is extended or adjusted under 35 U.S.C. 154(b) by 216 days.

(21) Appl. No.: 12/818,131

(22) Filed: Jun. 17, 2010

(65) Prior Publication Data

US 2011/0050108 A1 Mar. 3, 2011

(30) Foreign Application Priority Data

Aug. 31, 2009 (TW) ..... 98129293 A

(51) Int. Cl.
*H05B 37/00* (2006.01)

(52) U.S. Cl. ..... 315/291; 315/152; 315/308; 315/312

(58) Field of Classification Search ..... 315/291, 315/307, 308, 149, 159, 156, 157, 158, 312, 315/318, 313, 152, 154, 155
See application file for complete search history.

(56) References Cited

U.S. PATENT DOCUMENTS

| | | | | |
|---|---|---|---|---|
| 7,288,902 | B1 * | 10/2007 | Melanson | 315/291 |
| 7,719,209 | B2 * | 5/2010 | Hayes | 315/308 |
| 7,919,937 | B2 * | 4/2011 | Tracy et al. | 315/307 |

FOREIGN PATENT DOCUMENTS

| | | |
|---|---|---|
| TW | 480739 | 3/2002 |
| TW | I246207 | 12/2005 |
| TW | M314819 | 7/2007 |
| TW | 200731044 | 8/2007 |
| TW | 200841767 | 10/2008 |

* cited by examiner

*Primary Examiner* — David Hung Vu
(74) *Attorney, Agent, or Firm* — Jianq Chyun IP Office

(57) ABSTRACT

An illumination system including a master control unit, a device unit, a driving circuit unit, and an illumination unit is provided. The master control unit receives an input signal and outputs a control signal by performing a program operation processing to the input signal. The device unit analyzes the control signal so as to obtain a color temperature setting value and a brightness setting value, and generates two output signals according to the brightness setting value and two color temperature adjusting signals determined by the color temperature setting value. The illumination unit has at least two lamps with different color temperatures. The driving circuit unit receives and converts the two output signals so as to proportionally output two driving signals to respectively drive the two lamps. One of the two output signals is enabled after the other of the two output signals is disabled for a predetermined time.

20 Claims, 3 Drawing Sheets

ILLUMINATION SYSTEM AND ILLUMINATION CONTROL METHOD THEREOF

CROSS-REFERENCE TO RELATED APPLICATION

This application claims the priority benefit of Taiwan application serial no. 98129293, filed on Aug. 31, 2009. The entirety of the above-mentioned patent application is hereby incorporated by reference herein and made a part of this specification.

BACKGROUND OF THE INVENTION

1. Field of the Invention

The invention relates to an illumination technology, and more particularly, to an illumination system having functionalities of an adjustable color temperature and brightness adjustment and a control method thereof.

2. Description of Related Art

Cold color white light lamps or warm color white light lamps are usually chosen as light sources for indoor illumination. Generally speaking, if the cold color white light lamps are chosen, only cold color white light is emitted but the lamps may not be switched to warm color white light. However, if the lamps may be adjusted to warm color white light source in winter and adjusted to cold color white light source in summer, the lamps make people feel warm and cool in terms of visual sense.

Due to such an objective, Taiwan patent No. M314819 provides a "white light emitting diode (LED) illumination unit capable of adjusting brightness/darkness and color temperature (hereinafter referred to be 819' patent)". The 819' patent mainly utilizes a microcontroller to control two pulse width modulation (PWM) signals with a phase difference of 180 degrees therebetween, under a fixed power mode or a fixed current mode, for respectively modulating a light-up duration ratio of a warm color white light LED array to a cold color white light LED array and adjusting current level so as to adjust color temperatures and brightness/darkness required by a white light LED light source.

However, since the mechanism of respectively modulating the light-up duration ratio of a warm color white light LED array to a cold color white light LED array and adjusting current level proposed by the 891' patent utilizes two PWM signals with the phase difference of 180 degrees, the color temperatures may not be ensured to maintain unchanged when brightness and darkness are adjusted. Besides, suppose maximum power consumptions of the warm color white light LED array and the cold color white light LED array are respectively 50 Watts (W) and a maximum value of the PWM signals with the phase difference of 180 degrees is 100%, the 819' patent is required to utilize a power circuit design and components of high power consumption of 100 W (50 W×100%+50 W×100%), and the cost may be relatively high. In addition, Taiwan patent Nos. 480739, I246207 and Taiwan patent publication Nos. 200841767, 200731044 disclose techniques of adjusting color temperatures and/or brightness by controlling the red (R), green (G), and blue (B) LEDs.

SUMMARY OF THE INVENTION

The invention proposes an illumination system, and the illumination system may configure a color temperature setting value and a brightness setting value so as to achieve functionalities of adjustable color temperatures and a brightness adjustment.

Other objects and advantages of the present invention may be further understood by the technical features embodied and disclosed as follows.

In order to achieve at least one of the objectives, an embodiment of the invention provides an illumination system including a master control unit, at least a device unit, at least an illumination unit, and at least a driving circuit unit. The master control unit is configured for receiving an input signal and outputting a control signal by performing a program operation process according to the input signal. The device unit is coupled to the master control unit and configured for analyzing the control signal to obtain a color temperature setting value and a brightness setting value, and generating two output signals according to the brightness setting value and two color temperature adjusting signals determined by the color temperature setting value. The illumination unit has at least two lamps with different color temperatures. The driving circuit unit is coupled between the device unit and the illumination unit, and configured for receiving and converting the two output signals and proportionally outputting two driving signals to respectively drive the two lamps. Wherein, one of the output signals is enabled after the other of the two output signals is disabled for a predetermined time.

Another embodiment of the invention provides an illumination control method. The illumination control method includes: providing an input signal, and generating a control signal after performing a program process to the input signal; analyzing the control signal so as to obtain a color temperature setting value and a brightness setting value, and generating two output signals according to the brightness setting value and two color temperature adjusting signals determined by the color temperature setting value; converting the two output signals and generating two driving signals proportionally; and driving respectively at least two lamps of different color temperatures according to the two driving signals. Wherein, one of the two output signals is enabled after the other of the two output signals is disabled for a predetermined time.

In an embodiment of the invention, a duration ratio of the two output signals being respectively enabled determines a color temperature of the illumination unit.

In an embodiment of the present invention, a duration length of the two output signals being respectively enabled determines a brightness of the illumination unit.

In view of the above, in the foregoing embodiments of the present invention, since there is just one brightness setting value in the device unit, the color temperature may be maintained unchanged when the brightness is adjusted. Besides, since there is just one color temperature setting value in the device unit, a maximum power consumption may be ensured to be a half of the maximum power consumption of the illumination device. Thus, power circuit design and components with lower power consumption may be utilized to achieve an objective of saving cost. Furthermore, an objective of an adjustable color temperature may be achieved by modifying a duration ratio of the two output signals being respectively enabled; and an objective of an adjustable brightness may be achieved by modifying a duration length of the two output signals respectively being enabled.

Other objectives, features and advantages of the present invention will be further understood from the further technological features disclosed by the embodiments of the present invention wherein there are shown and described preferred embodiments of this invention, simply by way of illustration of modes best suited to carry out the invention.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

It is to be understood that other embodiment may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings.

Figure 1:
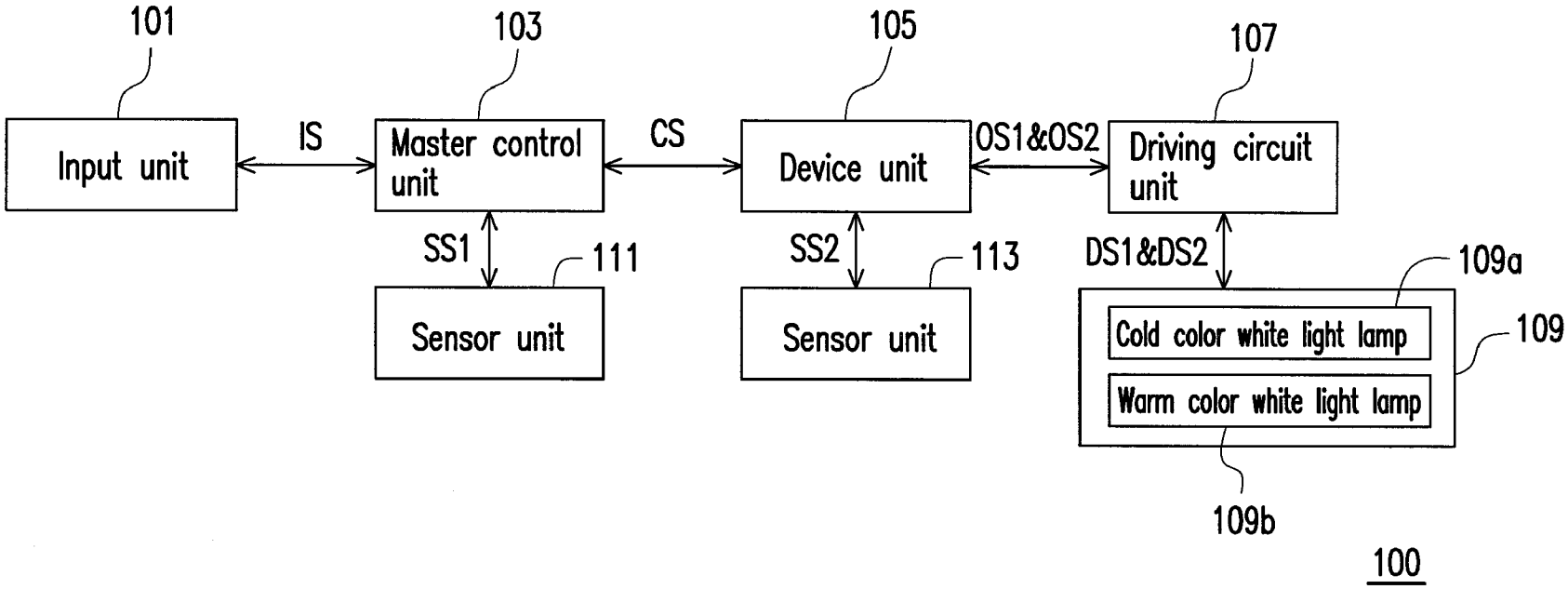
FIG. 1 is a block diagram illustrating an illumination system of an embodiment of the present invention.

Referring to FIG. 1, an illumination system 100 includes an input unit 101, a master control unit 103, a device unit 105, a driving circuit unit 107, an illumination unit 109, and two sensor units 111 and 113. Wherein, the input unit 101 may be coupled to or linked to the master control unit 103 through a wired or a wireless approach so as to provide an input signal IS to the master control unit 103.

In the embodiment, the input unit 101 may be a general switch, a computer apparatus, a touch-type controller or an acoustic controller, but is not limited thereto. Suppose the input unit 101 is a computer apparatus, the input unit 101 may be coupled to the master control unit 103 through a communication interface such as Transmission Control Protocol/Internet Protocol (TCP/IP) or Universal Serial Bus (USB) so as to provide light control settings (e.g. a color temperature settings and a brightness settings) of the input signal IS to the master control unit 103. Besides, suppose the input unit 101 is a touch-type controller, the input signal IS may be provided to the master control unit 103 through a touch panel used for a light control. Moreover, suppose the input unit 101 is an acoustic controller, the input signal IS may be provided to the master control unit 103 through audio band signals such as music or surrounding sounds.

When the master control unit 103 receives the input signal IS provided by the input unit 101, the master unit 103 may output a control signal CS after performing a program processing to the input signal IS. In the embodiment, the control signal CS may be a standard DMX512 signal, a Serial Peripheral Interface (SPI) signal or an inter-integrated circuit ($I^2C$), but not limited thereto. In addition, the device unit 105 may also be coupled to or linked to the master control unit 103 through a wired or a wireless approach and configured for analyzing the control signal CS output by the master control unit 103 to obtain a color temperature setting value SCT and a brightness setting value C, and generating two output signals OS1, OS2 according to the brightness setting value C and two color temperature adjusting signals CT, CT' determined by the color temperature setting value SCT.

Figure 2:
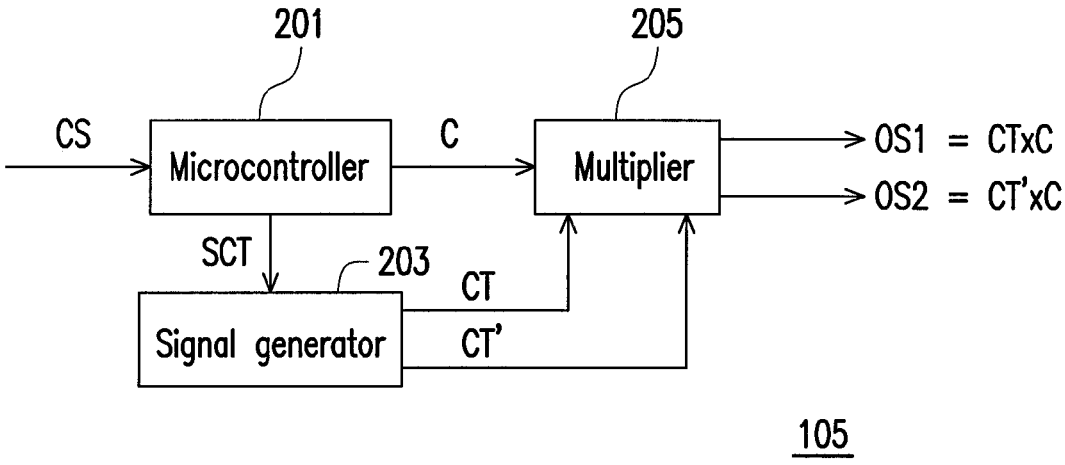
FIG. 2 is a block diagram illustrating a device unit of an embodiment of the present invention.

Referring to both FIG. 1 and FIG. 2, the device unit 105 includes a microcontroller 201, a signal generator 203, and a multiplier 205. The microcontroller 201 is coupled to the master control unit 103 and configured for receiving and analyzing the control signal CS so as to obtain the color temperature setting value SCT and the brightness setting value C, wherein the microcontroller 201 is, for example, a Central Processing Unit (CPU).

In the embodiment, the microcontroller 201 is just required to analyze information of two channels in the control signal CS (e.g., a standard DMX512 signal) output by the master control unit 103, and then obtains the color temperature setting value SCT and the brightness setting value C. Besides, the color temperature setting value SCT and the brightness setting value C may be stored in a non-volatile memory (not shown) in the master control unit 103, and make the color temperature setting value SCT and the brightness setting value C in the non-volatile memory as initial configuration values of the device unit 105.

The signal generator 203 is coupled to the microcontroller 201 and configured for receiving the color temperature setting value SCT and generating the two color temperature adjusting signals CT, CT' according to the color temperature setting value SCT. In the embodiment, the color temperature adjusting signal CT is a percentage (%) of the color temperature setting value SCT, and the color temperature adjusting signal CT' is a complement of the percentage (%) of color temperature setting value SCT, i.e.: "CT'=(100%−CT)". For example, suppose the color temperature setting value SCT is 80 (a range thereof is, for example, 1-100), but not limited thereto, then the color temperature adjusting signal CT is 80%, and the color temperature adjusting signal CT' is 20% (i.e., 100%-80%).

The multiplier 205 is coupled to the microcontroller 201 and the signal generator 203, and configured for receiving the brightness setting value C and the two color temperature adjusting signals CT, CT', and generating the two output signals OS1 and OS2 after respectively multiplying the two color temperature adjusting signals CT, CT' by a percentage of the brightness setting value C. This means that "OS1=CT×C (%)"; and "OS2=CT'×C (%)". For example, suppose the brightness setting value C is 50 (a range thereof is, for example, 1-100), but not limited thereto, then the output signal CT is 40% (i.e., 80%×50%) and the output signal OS2 is 10% (i.e., 20% x50%).

Figure 3:
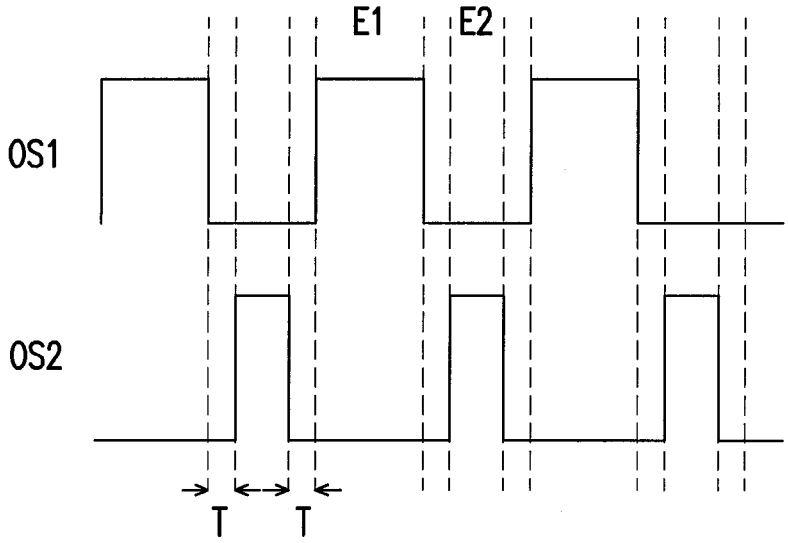
FIG. 3 is a block diagram illustrating two output signals output by a device unit of an embodiment of the present invention.

Referring to FIG. 1-FIG. 3, in the embodiment, one of the two output signals OS1, OS2 is enabled after the other of the two output signals OS1, OS2 is disabled for a predetermined time. In other words, a phase difference between the two output signals OS1, OS2 is not 180 degrees.

After the output signal OS1 is disabled for a predetermined duration T (the predetermined duration T may be determined according to practical design requirements), the output signal OS2 is enabled. Besides, after the output signal OS2 is disabled for a predetermined duration T, the output signal OS1 is enabled. In other words, the duration of the output signals OS1, OS2 being respectively enabled may not be crossover or overlapped. In practical applications, the two predetermined durations T of being disabled may be different, and may have a relationship of a ratio or a multiple. For example, the predetermined duration T labeled on the right side in FIG. 3 may be as two times of the predetermined duration T labeled on the left side, but not limited thereto, and the predetermined duration T may be determined according to practical design requirements. In the embodiment, the predetermined duration T may also be, for example, a percentage of cycles of the two output signals OS1, OS2. In addition, a duration ratio (i.e. a ratio of E1 to E2) of the two output signals OS1, OS2 respectively being enabled determines color temperatures of the illumination unit 109, and a duration length (i.e., widths of E1 and E2) of the two output signals OS1, OS2 respectively being enabled determines a brightness of the illumination unit 109.

In the embodiment, there are at least two lamps with different color temperatures in the illumination unit 109. For example, the two lamps may be a cold color white light lamp 109*a* and a warm color white light lamp 109*b*, but not limited thereto, and may be others such as a red light lamp, a green light lamp or a blue lamp, and both two lamps may be composed of LEDs. Besides, the driving circuit unit 107 is coupled between the device unit 105 and the illumination unit 109, and configured for receiving and converting the two output signals OS1, OS2, and proportionally outputting two driving signals DS1, DS2 to respectively drive the two lamps 109*a*, 109*b* with different color temperatures.

The driving circuit unit 107 herein may convert two output signals OS1 (40%), OS2 (10%) to the driving signals DS1 (40%), DS2 (10%) in forms of two output voltages/currents. Accordingly, after the driving signals DS1 (40%), DS2 (10%) in forms of two output voltages/currents are input to the illumination unit 109, for example, the warm color white lamp 109*b* and the cold color white lamp 109*a* in the illumination unit 109 may be respectively made to emit in a brightness ratio of approximately 40% to 10%. Also as a result of this arrangement, after the illumination unit 109 receives the driving signals DS1 (40%), DS2 (10%) output by the driving circuit unit 107, a change of color temperatures and/or brightness may be generated.

The aforementioned embodiments are described under a condition having two stages of the same predetermined duration T. However, in other embodiments, if the predetermined duration T (herein referred to as T1) labeled on the right side in FIG. 3 is two times of a predetermined duration T labeled on the left side (herein referred to as T2), the output signal OS1 may be maintained unchanged, and the output signal OS2 is changed to "CT'×C(%)−T2", i.e.: "OS2=CT'×C(%)−T2". In view of the above, suppose the brightness setting value C is also 50, then the output signal OS1 is 40%, and the output signal OS2 is as "10%−T2".

Accordingly, the two output signals OS1 (40%), OS2 (10%−T2) are converted to two driving signals DS1 (40%), DS2 (10%−T2) in forms of two output voltages/currents by the driving circuit unit 107 so as to make the warm color white lamp 109*b* and the cold color white lamp 109*a* in the illumination unit 109 to respectively emit in a brightness ratio of approximately 40% to "10%−T2". Also as a result of this arrangement, after the illumination unit 109 receives the driving signals DS1 (40%), DS2 (10%−T2) output by the driving circuit unit 107, the change of color temperatures and/or brightness may be generated.

In the embodiment, under a condition that the duration of the output signals OS1, OS2 being respectively enabled may not be crossover or overlapped, the embodiment may avoid that the cold color white light lamp is deactivated when the warm color white light lamp 109*b* is activated, and vice versa. Accordingly, the embodiment may not only reduce drastic current variations in the circuit so as to increase lifetime of components, and the embodiment may also avoid error actions of a circuit overloading protection, lower temperatures on circuit boards, improve electromagnetic interference (EMI), and prevent problems such as light flashing.

Furthermore, in order to achieve an objective that the duration of the output signals OS1, OS2 respectively being enabled may not be crossover or overlapped, in the embodiment, one of the two output signals with the phase difference of 180 degrees may be maintained, and the other signal of the two output signals is shifted to the left by a period of time, and also a duration length of enabling the output signal being shifted to the left is reduced by a period of time. Accordingly, two signals may be generated with the duration of respectively being enabled not crossover or overlapped.

Based upon the above, since there is just configured a brightness setting value C in the device unit 105, when the brightness of the illumination unit 109 is adjusted, the color temperature may be maintained unchanged due to that the two color temperature adjusting signals CT, CT' are at a same time multiplied by the percentage (%) of the brightness configuration value C. Besides, since there is just configured a color temperature setting value SCT in the device unit 105, a maximum power consumption of the illumination unit 109 may be ensured to be a half of the maximum power consumption.

For example, suppose the maximum power consumption values of the warm color white light lamp 109*b* and the cold color white light lamp are respectively 50 W, a maximum value of the color temperature adjusting signal CT is 100%, and the color temperature adjusting signal CT' is "100%−CT", then the maximum value of power consumption of the embodiment is just 50 W, i.e., "(50 W×100%×100%)+50 W×(100%−100%)×100%". Accordingly, power circuit designs and components with lower power consumptions may be used in the embodiment so as to achieve the objective of saving cost.

Furthermore, an objective of an adjustable color temperature may be achieved by just modifying a duration ratio of the durations E1, E2 of the two output signals OS1, OS2 being respectively enabled; and the objective of the adjustable brightness may be achieved by modifying lengths of durations E1, E2 of the two output signals OS1, OS2 respectively being enabled.

In addition, in order to make light source output by the illumination unit 109 have variations of color temperature and brightness, through the sensor unit 111 being coupled to the master control unit 103, the embodiment may output the sensing signal SS1 to the master control unit 103 by sensing environment variables, and make the sensing signal SS1 as a reference for the master control unit 103 self-adaptively adjusting the color temperature and the brightness of the illumination unit 109.

In the embodiment, the sensor unit 111 may be composed of a temperature sensor, a brightness sensor or a proximity sensor, and automatically adjust color temperature and brightness of the illumination unit 109 according to the sensing signal SS1 determined according to factors such as environment temperatures, brightness or people being in proximity. Accordingly, the light source output by the illumination unit 109 may have light atmospheres of different scenarios such as being bright or cozy, and may even make the lamps, surrounding decorations, artistic works or curtains to reflect a bright and concise atmosphere or to develop a cozy and harmonic atmosphere.

Besides, in the embodiment, the sensor unit 113 may be coupled to the device unit 105, and configured for outputting a sensing signal SS2 to the device unit by sensing an environment variable, and making the sensing signal SS2 as a reference for the device unit 105 self-adaptively adjusting the color temperature and the brightness of the illumination unit 109. Similarly, the sensor unit 113 may also be composed of a temperature sensor, a brightness sensor or a proximity sensor, and automatically adjust color temperature and brightness of the illumination unit 109 according to the sensing signal SS2 determined according to factors such as environment temperatures, brightness or people being in proximity.

Surely, in other embodiments of the invention, an infrared sensor or a smoke detector may be even added into the sensor units 111 and 113, so as to make the illumination unit 100 have functionalities of real-time alarm and security. In addition, in other embodiments of the invention, a remote control or a situation surveillance to the illumination unit 109 may be even enabled by using devices such as a personal computer, a mobile phone or a Personal Digital Assistant (PDA) through a communication interface such as Wireless Fidelity (WIFI) (but not limited thereto, other wireless communication interfaces may also be used) in collaboration with equipments such as a network camera.

Furthermore, through teachings of the aforementioned embodiments, persons skilled in the art of the invention may have no difficulty to deduce or reason by analogy to add a plurality of device units, driving circuit units, and illumination units in the illumination system 100 in other embodiments, so the design may not be described herein. If the illumination system 100 has a plurality of device units, driving circuit units, and illumination units, the master control unit 103 may adjust color temperature and brightness for all or respective illumination units, so as to make each of the illumination units have variations on color temperatures and brightness according to surrounding environment area or blocks (e.g., artistic works exhibited in a museum), and such varied embodiments also belongs to one of categories intended to be protected by the invention.

Figure 4:
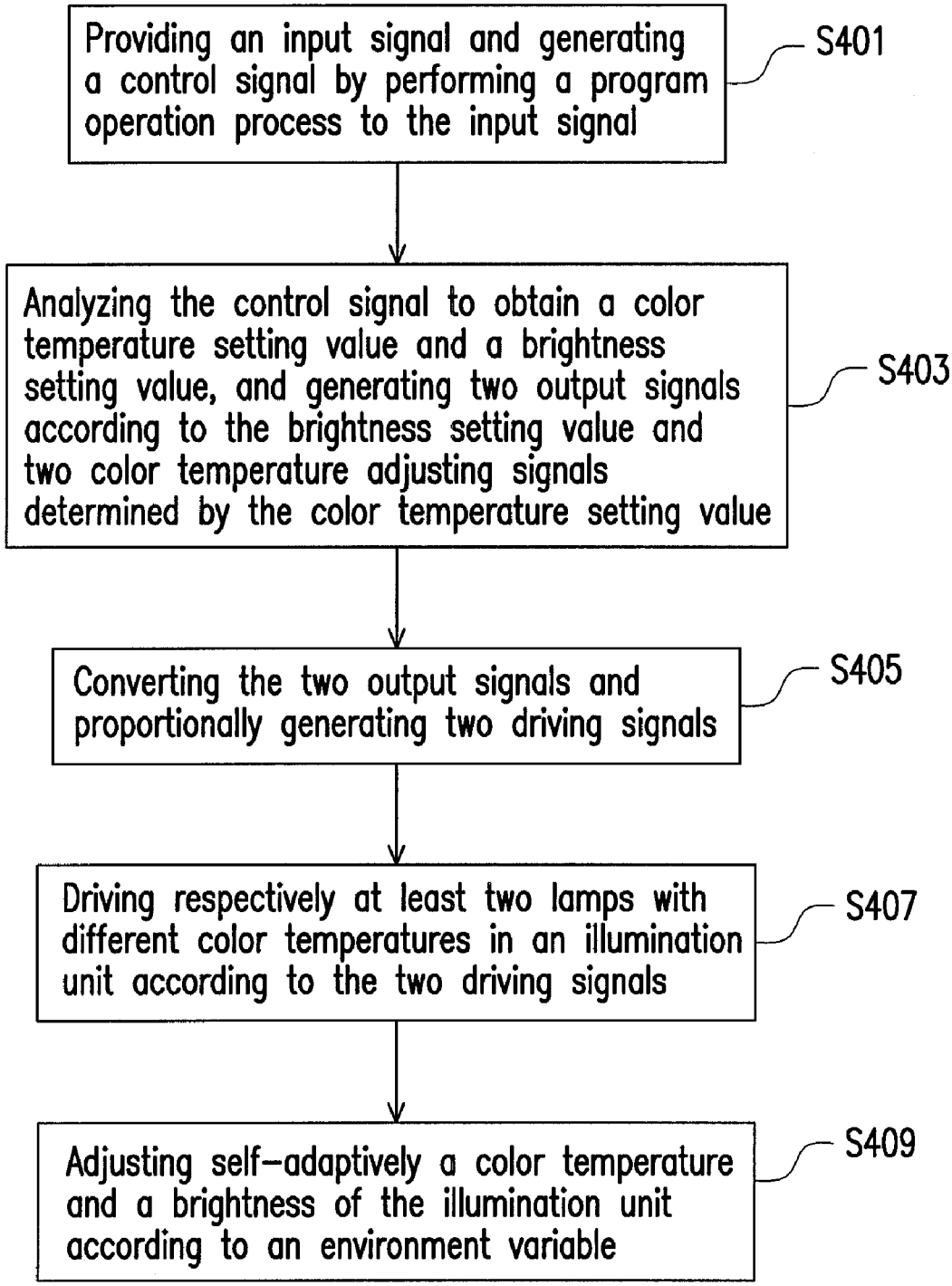
FIG. 4 is a flow chart illustrating an illumination control method of an embodiment of the present invention.

Based upon contents disclosed by the aforementioned embodiments, referring to FIG. 4, the illumination control method includes the following procedures. First, an input signal is provided, and a control signal is generated after a program computation process is performed to the input signal (step S401); then, a color temperature setting value and a brightness setting value are obtained after analyzing the control signal, and two output signals are generated according to the brightness setting value and two color temperature adjusting signals determined by the color temperature setting value (step S403). Afterwards, two output signals are converted and two driving signals are generated proportionally (step S405); then, two lamps with different color temperatures are respectively driven according to the two driving signals (step S407); finally, a color temperature and brightness of the illumination unit are self-adaptively adjusted according to environment variables.

In the embodiment, one of the two output signals is enabled after the other of the two output signals is disabled for a predetermined time. Besides, one of the two color temperature adjusting signals is a percentage of the color temperature setting value, the other color temperature adjusting signal is a complement of the percentage of the color temperature setting value, and two output signals are generated by respectively multiplying the two color temperature adjusting signals by a percentage of the brightness setting value. Furthermore, a duration ratio of the two output signals being respectively enabled determines the color temperature of the illumination unit; and a duration length of the two output signals respectively being enabled determines the brightness of the illumination unit.

In summary, the embodiment or embodiments of the invention may have at least one of the following advantages.

In the foregoing embodiments of the invention, since there is just configured a brightness setting value in the device unit, the color temperature may be maintained unchanged when the brightness is adjusted. Besides, since there is just configured a color temperature setting value in the device unit, a maximum power consumption may be ensured to be a half of the maximum power consumption of the illumination device. Thus, power circuit designs and components with lower power consumption may be utilized to achieve an objective of saving cost. Furthermore, an objective of an adjustable color temperature may be achieved by modifying a duration ratio of the two output signals being respectively enabled; and an objective of an adjustable brightness may be achieved by modifying a duration length of the two output signals respectively being enabled.

The foregoing description of the preferred embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. An illumination system, comprising:

a master control unit, configured for receiving an input signal and outputting a control signal by performing a program operation process to the input signal;

at least a device unit, coupled to the master control unit, configured for analyzing the control signal to obtain a color temperature setting value and a brightness setting value, and generating two output signals according to the brightness setting value and two color temperature adjusting signals determined by the color temperature setting value;

at least an illumination unit, having at least two lamps with different color temperatures; and at least a driving circuit unit, coupled between the device unit and the illumination unit, configured for receiving and converting the two output signals, and proportionally outputting two driving signals to respectively drive the two lamps, wherein, one of the two output signals is enabled after the other of the two output signals is disabled for a predetermined time.

2. The illumination system as claimed in claim 1, wherein the device unit comprises:

a microcontroller, coupled to the master control unit, configured for receiving and analyzing the control signal so as to obtain the color temperature setting value and the brightness setting value;

a signal generator, coupled to the microcontroller, configured for receiving the color temperature setting value and generating the two color temperature adjusting signals according to the color temperature setting value; and a multiplier, coupled to the microcontroller and the signal generator, configured for receiving the brightness setting value and the two color temperature adjusting signals, and generating the two output signals after respectively multiplying the two color temperature adjusting signals by a percentage of the brightness setting value.

3. The illumination system as claimed in claim 2, wherein the two color temperature adjusting signals comprise a first color temperature adjusting signal and a second color temperature adjusting signal.

4. The illumination system as claimed in claim 3, wherein the first color temperature adjusting signal is the percentage of the color temperature setting value, and the second color temperature adjusting signal is a complement of the percentage of the color temperature setting value.

5. The illumination system as claimed in claim 1, wherein a duration ratio of the two output signals being enabled determines a color temperature of the illumination unit.

6. The illumination system as claimed in claim 1, wherein a duration length of the two output signals respectively being enabled determines a brightness of the illumination unit.

7. The illumination system as claimed in claim 1, further comprising:

an input unit, coupled to the master control unit, configured for providing the input signal to the master control unit.

8. The illumination system as claimed in claim 7, wherein the input unit comprises a switch, a computer apparatus, a touch-type controller or an acoustic controller.

9. The illumination system as claimed in claim 1, further comprising:

a sensor unit, coupled to the master control unit, configured for outputting a sensing signal to the master control unit by sensing an environment variable, wherein the sensing signal is used as a reference for the master control unit self-adaptively adjusting the color temperature and the brightness of the illumination unit.

10. The illumination system as claimed in claim 9, wherein the sensor unit at least comprises a temperature sensor, a brightness sensor, a proximity sensor, an infra-red sensor or a smoke detector.

11. The illumination system as claimed in claim 1, further comprising:

a sensor unit, coupled to the device unit, configured for outputting a sensing signal to the device unit by sensing an environment variable, wherein the sensing signal is used as a reference for the device unit self-adaptively adjusting the color temperature and the brightness of the illumination unit.

12. The illumination system as claimed in claim 11, wherein the sensor unit at least comprises a temperature sensor, a brightness sensor, a proximity sensor, an infra-red sensor or a smoke detector.

13. The illumination system as claimed in claim 1, wherein the two lamps at least comprise a cold color white light lamp and a warm color white light lamp.

14. The illumination system as claimed in claim 1, wherein the control signal is a standard DMX512 signal, a serial peripheral interface signal or an inter-integrated circuit signal.

15. An illumination method, comprising:

providing an input signal and generating a control signal by performing a program operation process to the input signal;

analyzing the control signal to obtain a color temperature setting value and a brightness setting value, and generating two output signals according to the brightness setting value and two color temperature adjusting signals determined by the color temperature setting value;

converting the two output signals and proportionally generating two driving signals; and driving respectively at least two lamps with different color temperatures in an illumination unit according to the two driving signals, wherein, one of the two output signals is enabled after the other of the two output signals is disabled for a predetermined time.

16. The illumination method as claimed in claim 15, wherein the two color adjusting signals comprise a first color temperature adjusting signal and a second color temperature adjusting signal, and the first color temperature adjusting signal is a percentage of the color temperature setting value, and the second color temperature adjusting signal is a complement of the percentage of the color temperature setting value.

17. The illumination system as claimed in claim 15, wherein the two output signals are generated by respectively multiplying the two color temperature adjusting signals by the percentage of the brightness setting value.

18. The illumination method as claimed in claim 15, wherein a duration ratio of the two output signals respectively being enabled determines a color temperature of the illumination unit.

19. The illumination method as claimed in claim 15, wherein a duration length of the two output signals respectively being enabled determines a brightness of the illumination unit.

20. The illumination method as claimed in claim 15, further comprising:

adjusting self-adaptively a color temperature and a brightness of the illumination unit according to an environment variable.

* * * * *